US005135613A

United States Patent [19]

Waldmann

[11] Patent Number: 5,135,613

[45] Date of Patent: Aug. 4, 1992

[54] METHOD FOR CONTROLLING PITCH IN PAPER INDUSTRY USING PGAC OR PGUAC

[75] Inventor: John J. Waldmann, Charlotte, N.C.

[73] Assignee: Maxichem, Inc., Charlotte, N.C.

[21] Appl. No.: 650,309

[22] Filed: Feb. 4, 1991

[51] Int. Cl.[5] ..... D21H 21/02

[52] U.S. Cl. ..... 162/199; 162/DIG. 4; 162/164.6; 162/166; 162/168.2

[58] Field of Search ..... 162/199, DIG. 4, 158, 162/166, 168.2, 164.6

[56] References Cited

U.S. PATENT DOCUMENTS

| | | | |
|---|---|---|---|
| 3,290,310 | 12/1966 | Morfeta | 162/DIG. 4 |
| 3,703,563 | 11/1972 | Lipowski et al. | 162/DIG. 4 |
| 4,566,986 | 1/1986 | Waldmann | 210/716 |
| 4,765,867 | 8/1988 | Dreisbach | 162/DIG. 4 |
| 4,891,422 | 1/1990 | Waldmann | 524/612 |
| 4,902,779 | 2/1990 | Waldmann | 524/612 |
| 4,923,566 | 5/1990 | Shawki | 162/DIG. 4 |
| 4,997,523 | 3/1991 | Pease et al. | 162/DIG. 4 |

OTHER PUBLICATIONS

Gard "Some Practical Aspects of Chelation in Papermaking" TAPPI, vol. 47, No. 1 Jan. 1964.

*Primary Examiner*—Karen M. Hastings
*Attorney, Agent, or Firm*—John J. Waldmann

[57] ABSTRACT

Pitch formation in a paper mill is controlled by a chemical composition of a water-soluble polymer of polycyanoguanidineammoniumchloride (PGAC) or polycyanoguanidineureaammoniumchloride (PGUAC).

4 Claims, No Drawings

METHOD FOR CONTROLLING PITCH IN PAPER INDUSTRY USING PGAC OR PGUAC

BACKGROUND OF THE INVENTION

The present invention relates to composition of matter which are useful for inhibiting the pitch formation in paper mill and pigment dispersion and deposit control.

The mineral salts such as calcium or magnesium carbonate, or mixed salts creat very difficult problems in that such salts are absorbed by causing formation of crystal deposits. In the kraft or other alkaline line pulping process where surfactants, dispersants and other agents are used, the removal of the deposits from pulp-mill equipment is very costly. Production must be stoped for equipment cleaning operation and the presence of volatile organic solvents, which most of the time include petroleum, is dangerous and very unhealthy to worker personnel.

The deposit of pitch and/or pigments in pulp slurries occurs throughout the paper manufacturing process. The term "Pitch" per se and the other gums, rosin and resin which result from the production of cellulose fiber by the pulping step of paper manufacture, cooking and mechanical process during the pulping by the kraft, ground wood or sulfite process produce the pitch and are incorporated in the "Pitch" terminology. The mechanical process employs beating, hydrating, refining and bleaching. The pitch agglomerate, or in crystal form, deposits, or frequently causes the formation of spots or holes in the sheet formed or may adhere to the wire or press rolls or dries rolls and cause tearing of the sheet, or numerous imperfections of sheets.

DESCRIPTION OF THE PRIOR ART

The most efficient prior pitch control agents are sodium salts of sulfonated naphthalene-formaldehyde condensate, non-ionic dispersants, anionic polymers, sodium polyacrylate and arylsulfonic acid condensate, polyphosphates, terpolymers, ethoxylated organic substances like phenols, tall oils, (co) polymers of ethylene oxide and propylene oxide, vicinal epoxide and phenol, blend of kerosine-emulsifiers, and special cationic wet additives. Such prior art pitch control processes are disclosed by U.S. Pat. Nos.: 2,144,756; 2,399,489; 2,716,058; 2,999,045; 3,081,219; 3,446,700; 3,639,208; 3,840,489; 3,873,417; 3,992,249; 4,184,912; 4,190,491; 4,673,460; 4,634,451; 4,657,593; 4,818,288; 4,867,972; 4,952,277 which are incorporated by reference herein. All the methods described in these patents are still inefficient as pitch, or additive control agents.

The invented products, water-soluble cationic, or cationic-nonionic, or nonionic charged guanidine derivatives such as guanidine, or cyanoguanidine, or biguanidine, or guanylurea, or substituted guanidine polymer(s), or resins, or copolymers with urea, or amines, or N-hydroxy, or N-hydroxyalkyl amines, or their resins, or melamine-aldehyde resins protonized, or quaternized, or hydroxy, or hydroxyalkyl-s-triazine-2,4 amine products protonized, or quaternized, or aminoplast resins, or those organic blends, or their alloys, are very efficient as pitch control additives in pulping operations, including introduction prior or after digestion in the stock-chest, or even in the head box, hollander, or other feeding points, or the papermaking machine, or as additive for sizing, or improved fillers retention, or for improvment of wet strength of paper. The deposit of adhesive in pitch particles from water suspension of cellulose fiber is prevented from depositing on surface of pulp-making equipment. In the pitch control operation it is preferred to add the additives early in the pulping or papermaking stage before the pitch is coagulated on the pulp during the papermaking operations. The additives are added at an effective amount to the pulp material at dosage from about 0.02 to 2.0 weight percent (% bw) additives to dry pulp, or can be used in formulation with nonionic, or anionic surfactants, or nonionic or charged polymers, or (co)polymers. The additive products are more economical than any other polymeric materials in the market, and more efficient then well known products in the art today.

OBJECTS OF THE INVENTION

It is principal object of this invention to provide a chemical composition useful for pitch control, or in paper making processes. It is also an object of this invention to provide a method for controlling pitch, or filler dispersions, in papermaking, or pulp refining process. The additive of the invention are added at a sufficient amount, at a point prior to where pitch deposits occur, or in a paper making process at a rate of at least 0.25 ppm to 1000 ppm, based on the weight of the dry pulp. Other objects will appear hereinafter.

The term ppm means parts of polymer, or resin by weight per million parts by weight of aqueous phase of the fibrous suspension. Another big advantage of this invention is that in the pitch control process the use of expense solvents, or steam cleaning the machinery which causes loss of production is eliminated. To avoid the forgoing problems, it was found advantageous to add to the various fiber slurries a small amount of the described aqueous polymer, aqueous resin solution of this invention.

SUMMARY OF THE INVENTION

The invention generally relates to aqueous organic blend(s), or alloy(s), polymer or copolymer(s), or resin(s), or resin blend(s) of the general formula:

$$-[X]_n-=[B]_x+[C]_y$$

wherein n=500 to 100,000 molecular weight (Mw);

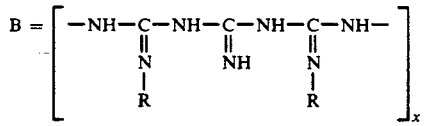

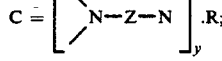

B is a water-soluble cationic, nonionic, or mixture cationic-nonionic charged guanidine derivative selected from the group consisting of guanidine, cyanoguanidine, biguanidine, guanylurea, their polymers, copolymers, resin, copolymer with urea, amines, N-hydroxyalkyl amines, alkanolamines, melamine, hydroxy or hydroxyalkyl-s-triazine-2,4,6 or 2,4 amines, aldehyde condensate, protonized or quaternized;

C is a water-soluble cationic, nonionic, or mixture cationic-nonionic charged melamine derivative selected from the group consisting of melamine, hydroxy or hydroxyalkyl-s-triazine-2,4,6 or 2,4 amine aldehyde condensate polymers, copolymers, resin or blends, guanylmelamine, protonized or quaternized products;

Z is a divalent substituted or unsubstituted organic radical;

R refers to hydrogen, bridge cationic, multiple cationic charges, protonization or quaternization agents selected from the group consisting of inorganic or organic acids, ammonium salts (Cl, $SO_4$, $NO_3$, $CH_3COO$), methyl halide or alkyl ($C_1$–$C_2$) sulfate, which vary from 0% to 80% by weight, and at least one of B or C is positive;

X is defined by the individual molecular weight which may vary from 500 to 100,000 of the water-soluble polymer, copolymer, or resin used;

n is 500 to 100,000 molecular weight;

x is 0% to 100% by weight;

y is 0% to 100% by weight and at least one of B, C is positive.

Mixtures of the above inorganic, or inorganic-organic, or organic, or blend(s), polymer(s), or copolymer(s), are described in U.S. Pat. Nos. 4,891,422, 4,902,779, and U.S. patent application Ser. No. 07/409,396 filed Sep. 19, 1989 filed Aug. 11, 1987.

DETAILED DESCRIPTION

This invention is based on water soluble polymers, resins, or polymer blends. Polyblends may be made from polymeric components by mixing, or compounding them together. This invention concerns homogeneous (compatible) blends, a single phase mixture, which are compatible. The component B can be 0% to 100% by weight (bw) and component C can be 0% to 100% bw in composition, provided that at least one component is positive, which will determine the X value. So, the X can be B, C or mixture of B+C and not a reaction product; these are two independent products or species.

If $C_y$, y is zero (y=0) that means product C is not present at all, so B is 100%, or if it is used in diluted form, as example 50% bw, that means the rest is water since this invention concerns water soluble products, and not solvent type products.

The preparation of polyguanidine or polyguanidine compositions polymer, or (co)polymer(s), or resin(s), or alloy(s), or blend(s) is described in U.S. Pat. Nos. 4,891,422, 4,902,779, protonized or quaternized. The guanidine or melamine polymer(s), or resin(s) may be made in pH range from 0.5 to 11, preferably 5 to 9 and most preferably 3 to 5.5. In general, a process for preparation of polyguanidine, or polymelamine, or their organic blend comprises the steps of:

mixing guanidine derivatives such as guanidine, or cyanoguanidine, or hydroxy or hydroxyalkyl-s-triazine-2,4,6 or 2,4 amines with aldehyde(s) and water and preferably aliphatic amines, or polyamine or alkanolamine, or urea, or thiourea, adjusting the pH to the range of pH 3.0 to 10, heating the mixture from room temperature (RT) to about 110° C. for a period of 10 minutes to 4 hours, at from atmospheric pressure up to 0.25 to 25 $Kg/cm^2$, the resin, or (co)polymer formed being protonized, or quaternized with mineral acid(s), or organic acid(s), or ammonium salts (of chloric, sulfuric, nitric acids), or quaternized by alkyl halide, or dialkyl ($C_1$–$C_2$) sulfate, or halobenzyl, or arylsulfonic acid(s), at a temperature from about 45° C. to about 85° C. In the formula C, divalent radical Z is an aliphatic, heterocyclic, or aromatic substituted or unsubstituted melamine, or guanidine, or guanyl substituted such as melamine, or guanylmelamine, or acetoguanamine, hydroxy/or hydroxyalkyl-s-triazine-2,4,6/or 2,4 amines. The invention is further illustrated by the following examples. It will be understood that these examples are not intended as limiting the invention, but rather as disclosing the operation of the invention.

EXAMPLE NO. 1

0.05% bw of polycyanoguanidineammoniumchloride (PGAC) was added to the pulp solids material before the headbox. The PGAC inhibited the agglomeration of pitch crystals and resin deposits, and the machine produced paper without interruption.

EXAMPLE NO. 2

0.6% bw of polycyanoguanidineurea ammoniumchloride (PGUAC) was added to the pulp solids sulfite cellulose (paper pulp) in the hollander. The polycyanoguanidineurea ammoniumchloride (PGUAC) was added for 11 days and inhibited the agglomeration of the pitch crystals and resin deposits, and the machine produced paper without interruption.

EXAMPLE NO. 3

1.0% bw of cationic polycyanoguanidineammoniumchloride was added to the pulp solids material before the headbox. The cationic polycyanoguanidineammoniumchloride inhibited the pitch formation and the machine produced paper without interruption.

EXAMPLE NO. 4

One part of the product of Example No. 1 is mixed with 3 parts of the product of Example No. 3 and 0.6% bw of this mixture was added to the pulp paper in the hollander. The multicationic polycyanoguanidine ammoniumchloride for over 27 days inhibited the pitch formation on paper machine, or hollander walls, or wire and or felt.

EXAMPLE NO. 5

The conditions of Example No. 4 were repeated by substituting the polycyanoguanidineammoniumchloride with cationic polyguanylmelamine quaternized (methyl sulfate) polymer blend. 1.95% bw was added before the headbox. The pitch deposits were inhibited and the machine produced paper without interruption.

The sheet paper made also from this product was found to have good resistance to bursting after 30 seconds or 30 minutes immersion in water.

What is claimed is:

1. A method for controlling pitch in paper mills, comprising incorporating in the method, at a point prior to where pitch deposits occur, an effective amount of a composition consisting essentially of a water-soluble polymer selected from the group consisting of polycyanoguanidineammoniumchloride or polycyanoguanidineurea ammoniumchloride, said polymer having a molecular weight from about 500 to 100,000.

2. The method of claim 1 wherein at least 0.25 ppm of composition is incorporated.

3. The method of claim 1 wherein from about 50 to 1000 ppm of the composition is incorporated.

4. The method of claim 1 wherein the composition is incorporated at a headbox or hollander before the pitch deposits occur.

* * * * *